US005379711A

United States Patent [19]

Fischer et al.

[11] Patent Number: 5,379,711

[45] Date of Patent: Jan. 10, 1995

[54] RETROFITTABLE MONOLITHIC BOX BEAM COMPOSITE HULL SYSTEM

[75] Inventors: Eugene C. Fischer, Stevensville; Roger M. Crane, Arnold, both of Md.

[73] Assignee: The United States of America as represented by the Secretary of the Navy, Washington, D.C.

[21] Appl. No.: 953,620

[22] Filed: Sep. 30, 1992

[51] Int. Cl.[6] ..... B63B 25/08

[52] U.S. Cl. ..... 114/74 A; 114/342; 206/592; 206/594

[58] Field of Search ..... 114/74 A, 342, 354–358, 114/343, 227, 228, 267, 11–13; 206/584, 591–594; 188/371, 373, 376, 377; 52/806, 808

[56] References Cited

U.S. PATENT DOCUMENTS

| | | | |
|---|---|---|---|
| 2,405,590 | 8/1946 | Mason | 114/12 |
| 3,598,275 | 8/1971 | Francois | 114/342 |
| 3,637,051 | 1/1972 | Paine | 188/376 |
| 4,492,291 | 1/1985 | Chometon | 188/377 |
| 4,548,154 | 10/1985 | Murata | 114/74 A |
| 4,674,430 | 6/1987 | Murata | 114/74 A |
| 4,744,321 | 5/1988 | Pfeuffer | 114/74 A |
| 4,901,486 | 2/1990 | Kobori | 188/377 |

*Primary Examiner*—Robert J. Oberleitner
*Assistant Examiner*—Clifford T. Bartz
*Attorney, Agent, or Firm*—Howard Kaiser; Charles D. Miller

[57] ABSTRACT

A double hull structure includes a controllably crushable stand-off structure for maintaining a separation between inner and outer hulls and may be retrofit onto existing hulls either in modular and/or break-away sections or as a complete "shoe" enclosing the existing hull. This retrofittable hull is preferably of a non-metallic composite material which reduces or eliminates corrosion of the existing hull, extending the usable lifetime thereof. The controllably crushable stand-off structure is designed to provide sequential failure, preferably by sequential energy absorbing brittle fractures with little elastic deformation, to provide protection of the existing hull during collisions and/or groundings and thus enhance cargo containment. The brittle fracture is preferably provided by the use of non-metallic composite material in beams of the stand-off structure and/or the inclusion of syntactic foams.

27 Claims, 2 Drawing Sheets

RETROFITTABLE MONOLITHIC BOX BEAM COMPOSITE HULL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to hull structures for water-borne vessels and, more particularly, to double hull structures having improved resistance to damage and cargo containment.

2. Description of the Prior Art

Double hull designs for hull structures for water-borne vessels are known and have been used to achieve several design purposes such as provision of buoyancy and increasing hull rigidity. Double-hull designs became particularly prominent when the *Great Eastern*, the largest vessel to have been built at that time incorporated a double-hull design. More recently, however, double-hull designs have been considered for the purpose of improving cargo retention for flowable cargoes such as liquid oil or pulverent materials such as grain or coal which are loaded directly into the hull of the vessel for transport and are not otherwise contained. The theory of such a double-hull construction is that, upon grounding or collision with another vessel which may pierce the outer hull, the inner hull will be more likely to remain intact to prevent sinking of the vessel and to contain the cargo, preventing spillage into the environment.

At present, there is an average annual spillage of 9,000 tons of crude oil and petroleum products in U.S. waters. Large spills of 30,000 tons or more, however, while constituting only about 3% of events in which spillage occurs, accounts for nearly 95% of the quantity of accidental spillage in U.S. waters. This spillage, particularly from large spills represents a major economic cost which has only recently been considered as an aspect of efficiency of hull performance. In particular, single hull designs which were previously considered to be more "efficient" have reduced allowances for deterioration and accidents such as groundings and collisions to a significant degree. Such vessels will cause spillage whenever the single hull is pierced.

However, even double hull structures, as designed and fabricated in the past, have numerous drawbacks. A double hull design of steel will necessarily increase the construction and material costs of vessel production, especially due to the labor intensive joining requirements of welding of the hulls as compared with single hull designs. Even though hull plate thickness may be halved in a double hull design to reduce material cost, the labor intensiveness of joining sections greatly outweighs any potential savings. Increased weight due to the joining of hull sections also implies a substantial increase in empty hull displacement, increasing wetted area of the hull for a given cargo mass or volume and requiring increased motive power and fuel consumption for the vessel. Further, the space between the hulls is not readily accessible for inspection and maintenance (particularly since double hull designs are typically compartmentalized), increasing the costs of vessel operations. This is particularly important in double hull designs fabricated from steel since weldments for joining the steel plates of the hull will typically not be fully watertight and will form a source of slow leakage. This exposure to sea water in inaccessible locations forms a serious problem of corrosion and corrosion prevention. For this reason, hull deterioration which may affect the sea-worthiness of the vessel are not readily detectable.

Perhaps more importantly, to assure good performance of the outer hull as protection for the inner hull, a rule-of-thumb has been developed that the outer hull should be separated from the inner hull by about 1/10th to 1/15th or 6.7% to 10% of the beam of the vessel for conventional metallic design. This separation has been determined from the potential shock absorbing qualities of double hull designs. It should be noted in this regard that traditional structural materials such as steel, when subjected to a force will yield elastically over a substantial dimension before inelastically yielding. Little energy dissipation occurs during the elastic deformation because of the high stiffness of the material, whereby the forces are passed directly to the inner hull and the only benefit to be derived in protection from grounding or collision damage during elastic deformation is the spreading of the forces which are encountered. Therefore, a substantial distance must be provided so that the point of inelastic deformation can be reached under such circumstances and energy can, in fact be dissipated to protect the inner hull.

This rule-of-thumb has enormous economic consequences for several reasons. For example, the beam of a large tanker may run to well in excess of 100 feet and a separation between inner and outer hulls would thus be in excess of 6.5 feet. This increases the beam of the vessel by over 13%, greatly increasing wetted surface and frontal area of the vessel. Further, the volume of unusable space greatly diminishes the cargo carrying capacity for a given hull displacement. Additionally, structure must be provided between the inner and outer hulls which increases the material cost and weight and labor in the fabrication of the hull and reduces the efficiency of the vessel.

These factors are especially aggravated in the case of barges used on intercoastal waterways. Such barges often have beams (e.g. the width of the vessel) in excess of 200 feet. While double hull constructions may possibly be cost-effective in ocean-going tankers when the actuarial costs of damage from cargo spillage and other non-operational costs (such as adverse publicity incident to spillage into the environment) are considered, double hull structures for such barges is considered prohibitive.

Over the operational lifetimes of vessels now in service (e.g. over the past approximately thirty years), costs incident to cargo spillage have generally not been considered in the design of cargo vessels. Consequently, virtually all cargo vessels now in service are of single hull design. While these vessels represent a substantial economic investment, they also represent a substantial hazard to the environment and a potential major liability to owners and operators. Therefore insurance rates for such vessels have greatly increased in recent years. On the other hand, replacement of such vessels with double hull vessels represents an extremely large cost both in terms of the cost of new vessels and the loss of usable lifetime of the vessels replaced. Insurance rate savings are not fully realized, in any event, due to the difficulty of inspection and the determination of sea-worthiness of double hull structures after they are placed in service. Operational costs would also be increased due to both the reduced cargo capacity for a given hull displacement and for amortization of the cost of new hull construction and the loss of useful lifetime of replaced single hull vessels.

In view of the above considerations, particularly under the present atmosphere of environmental sensitivity and regulation, double hull designs fabricated from metal presents an economically and technically inadequate solution to the problems of damage limitation and cargo containment during groundings and collisions of large vessels.

SUMMARY OF THE INVENTION

It is therefore an object of the present invention to provide a hull structure which is retrofittable onto existing vessels and which will increase the useful lifetime thereof.

It is another object of the invention to provide a structural system which will provide increased resistance to hull penetration during groundings and collision and of reduced weight and thickness and having limited effect on the performance of vessels on which the structural system is installed.

It is a further object of the invention to provide a structural system for the hull of vessels which is easily and economically fabricated and repaired.

It is yet another object of the present invention to provide a single to multiple layer hull conversion system which is applicable to existing vessels.

It is another further object of the invention to improve the performance of double or multiple layer hull structures under grounding and collision conditions and having improved energy absorbing properties.

In order to accomplish these and other objects of the invention, a hull structure is provided comprising an inner hull having a predetermined compressive strength, an outer hull having a predetermined compressive strength, and stand-off structure for maintaining separation between said inner hull and said outer hull for absorbing energy by sequential failure of portions of said stand-off means at forces less than said predetermined compressive strength of said inner and outer hulls.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
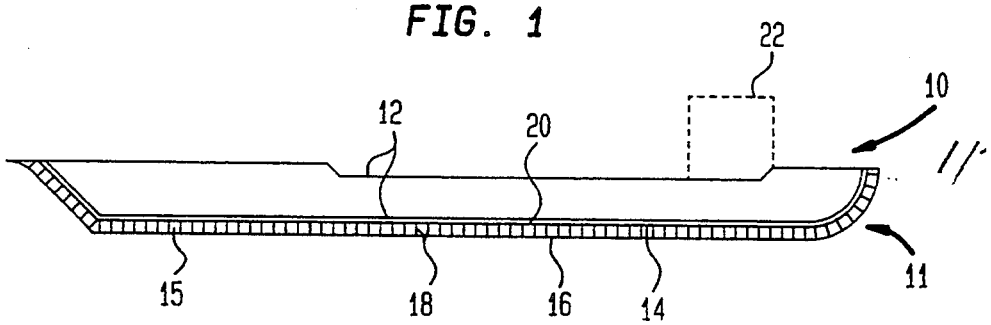
FIG. 1 is a longitudinal hull cross-section in accordance with the present invention.
Figure 2:
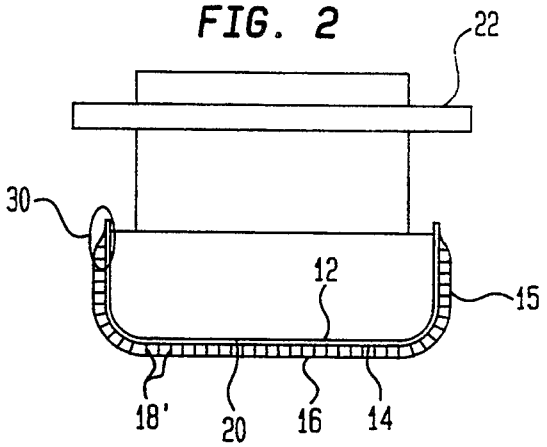
FIG. 2 is a hull cross-section in accordance with the present invention taken parallel to the beam of the vessel.

Referring now to the drawings, and more particularly to FIG. 1, there is shown a schematic longitudinal cross-section of the invention 10 as retrofit to the hull 12 of an existing single hull vessel. A cross-section of the invention taken parallel to the beam of the vessel is shown in FIG. 2 and similar reference numerals are used in both Figures insofar as possible. While such an application of the invention may provide the most significant economic advantage and the invention will therefore be explained in connection therewith, it is to be understood that the invention is also applicable to new construction of vessels and will produce similar advantages therein.

Over the outer surface of the existing hull 12 a double hull construction including inner hull 14 and an outer hull 16. The inner hull 14 and outer hull 16 are preferably kept separated by bulkheads or stand-offs 18 which are preferably of a controllably crushable form, as will be discussed in detail in regard to FIGS. 4–6, to provide sequential failure and energy absorption during grounding or collision with other vessels. The inner and outer nulls together with the stand-offs thus provide a "shoe" 11 which is fitted around an existing vessel. It is contemplated that the "shoe" 11 thus formed will be substantially rigid and structurally robust although it is preferably designed to use the existing hull as a structural member therein to provide additional stiffness. Therefore the complete combination of "shoe" 11 and the existing hull are considered to be an embodiment of the invention while the subcombination "shoe" 11, itself, is also regarded as an embodiment of the invention.

Figure 3:
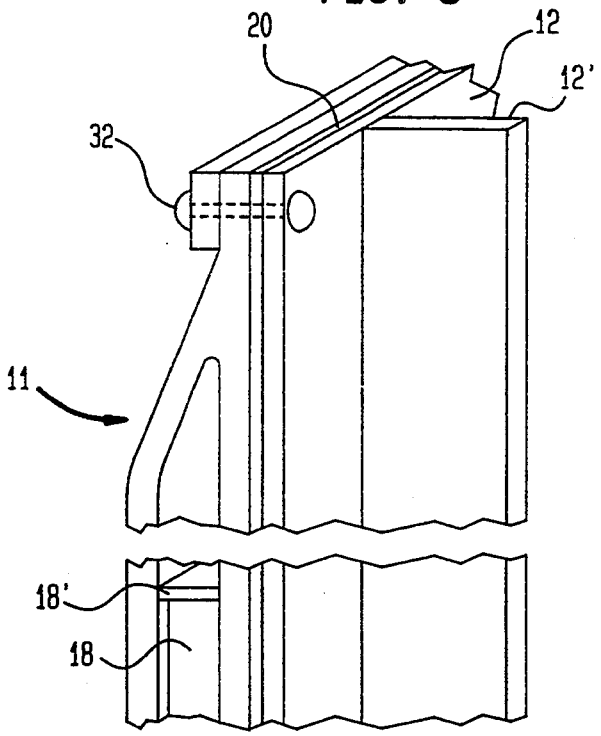
FIG. 3 is an isometric cut-away view of the structure of the invention showing installation details thereof, FIG. 4 in a cross-section of a crushable beam in accordance with one embodiment of the invention, FIG. 5 in a cross-section of a plurality of crushable z-beams in accordance with another embodiment of the invention.

Space 20 is also illustrated in FIGS. 1–3 between "shoe" 11 and existing hull 12. In practice it is contemplated that a void filling adhesive, with or without a filler material such as glass fibers, would be used to fill any voids which may be present and to provide a high shear strength joint between the "shoe" 11 and existing hull 12. At present levels of skill in the molding of composite materials, it is expected that the "shoe" can be made to fit quite closely around the existing hull and space 20 can probably be accommodated with various available fairing compounds used widely in the industry.

It is preferred that the "shoe" be formed of a composite, non-metallic, material such as a glass fiber reinforced plastic (GRP). While other fiber materials could be used, glass fiber reinforcement is currently preferred due to its high compressive strength which effectively resists penetration and tearing. These materials, regardless of the fiber reinforcing material, can be easily molded and molded portions connected through co-curing, possibly with the use of a heat gun, or adhesively bonding the sections together.

The "shoe" can be formed in modules which may be economically preferable for some shapes of existing hulls 12 since many existing vessels, such as tankers and barges, have a constant cross-sectional shape over a major portion of the length thereof. However, it is otherwise considered preferable to fabricate the "shoe" 11 complete as a watertight hull, allowing convenience of welding at the inner hull 14, which can then be flooded, "floated" into position below an existing hull and then raised and pumped out to cause the "shoe" 11 to enclose the existing hull 12. This latter technique is considered especially appropriate to fitting the "shoe"

11 to barges which carry no propulsion arrangements which must be accommodated. The same technique can also be used when the "shoe" is formed in a modular fashion and may be preferable for exceptionally large vessels. Even if large sections of the "shoe" must be later fitted to the existing hull (thus caucusing holes to be left in the "shoe" during installation, buoyancy of the "shoe" may be adjusted by either flooding the compartments 15 formed by bulkheads and/or stand-offs 18 between the inner and outer hulls 14, 16 of the "shoe" or by ballasted floodable tanks which could be attached to the "shoe" during installation. After such installation of a substantially complete "shoe", adhesive may be placed in space 20 by injection. Alternatively, viscous adhesive material could be enclosed within a membrane to protect the adhesive from water contact, if necessary, and to assure adequate distribution as the existing hull and the "shoe" are brought into close proximity. In either case, if the adhesive is of the non-hardening type, some degree of self-sealing action for minor hull leaks can also be achieved.

The retrofitting of a "shoe" 11 to an existing hull 12 has several substantial benefits. Possibly most important among these benefits is that composite GRP materials are not subject to corrosion and retrofitting a composite material "shoe" 11 will arrest further corrosion and other electrolytic effects since it is non-conductive. Therefore, application of this invention to steel hulls which are nearing the end of their useful lifetimes can serve to extend that useful lifetime many years beyond that which would otherwise be expected. Additionally, the cost of fabrication of the existing complete vessel including non-hull systems and structures collectively illustrated by superstructure 22 would be preserved and need not be duplicated, even though an essentially new vessel is provided by the attachment of "shoe" 11. Further, since the "shoe" itself is substantially rigid and structurally robust, the overall strength of the combination hull 10 is made substantially stronger than either "shoe" 11 or existing hull 12 taken alone. Substantial resistance to damage during grounding and/or collision is also conferred by the "shoe" and hull penetration resistance and cargo containment is virtually assured because the combination hull 10 now comprises at least two membranes having high resistance to tearing overlying the original hull. These membranes together with the stand-off and bulkhead structure also provide substantial distribution of forces and absorption of energy encountered in grounding or collisions and reduce forces transmitted to the steel hull containing the cargo.

Referring now to FIG. 3, which shows an enlarged view of region 30 of FIG. 2 in isometric form, it is seen that the "shoe" 11 is preferably affixed to the existing hull 12 including existing internal bulkheads or other structures 12' by merely applying adhesive in space 20 and through-bolting the "shoe" 11 to the existing hull 12 with a bolt, rivet or other fastener 32. If the invention is applied to new vessel construction, internal structures 12' such as those known in the art but possibly also made of a composite (e.g. GRP) material may be directly applied to the "shoe" or molded integrally therewith.

The relationship of the stand-offs or bulkheads 18, 18' is also more clearly shown in FIG. 3. These structures need not be provided throughout the "shoe" but should at least extend for a short distance above the design waterline of the combination hull 10 or the "shoe" 11. Nevertheless, omission in the upper portions of the "shoe", as illustrated, simplifies construction of the "shoe" and provides for some shearing between "shoe" 11 and existing hull 12 during grounding or collision impact, further dissipating energy and distributing forces over hull 12. Particularly if the "shoe" 11 is formed in a modular fashion, this method of attachment may provide for breaking away of portions of the "shoe" 11 during such impacts and affording a further degree of protection of hull 12 and a further stage of sequential failure in order to protect hull 12 from penetration by effectively reducing shear forces below the tear resistance of hull 12.

Figure 4:
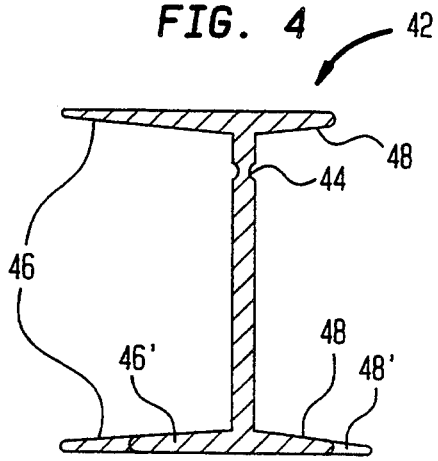

It is considered to be an important feature of the present invention to provide for sequential failure and energy absorption during grounding and/or collisions of the vessel. Therefore, while the stand-offs between the inner hull 14 and the outer hull 16 of the "shoe" 11 must provide a substantial degree of rigidity to the "shoe", it is also desirable to provide for sequential failure and energy absorption during controlled crushing of portions of the "shoe". Referring now to FIG. 4 a stand-off structure in accordance with one particular embodiment of the invention is illustrated in cross-section. The beam 42 shown in cross-section in FIG. 4 is therefore provided with notches 44 which tend to concentrate any forces applied to the flange of the beam causing inelastic deformation to occur at relatively low amounts of overall distortion of the beam. If forces applied to the beam are static and tend to keep the web of the beam in compression (e.g. when static compressional forces are placed against the hull as when the vessel is in dry-dock), the compressional forces, while somewhat concentrated at notch 44, will not cause inelastic deformation of the beam. The effect of controlled failure together with minimizing the likelihood of tearing of the inner or outer hulls 14, 16 of "shoe" 11 may also be regulated to a substantial degree by asymmetric formation of the flanges of the beam, as shown by relatively greater width of flanges 46 and 48. As variation on the invention, much the same effect can be achieved by providing notch 44 on only one side of the beam or asymmetrically offsetting the flange widths as shown at 46' and 48' in comparison to the flanges 46 and 48 at the upper web, as beam 42 is illustrated in FIG. 4.

It should be noted in FIG. 4 and also in FIGS. 5 and 6, to be discussed below, that the design of the actual beams and other stand-off types of structures are standard problems regarding strength of materials and thus within the abilities of those skilled in the art in view of the present disclosure. The primary design considerations are that the stand-offs should behave differently in shear and compression and the failure mode load should fall between the loads presented by the vessel when fully loaded and the force necessary to cause tearing or penetration of the existing hull 12. While a substantial safety factor will be presented by the tear resistance of the composite materials of which the "shoe" 11 is preferably fabricated, a force encountered in the grounding of the vessel will involve high shearing forces as well as compressional forces sufficient to slightly but rapidly lift the vessel. In collisions, while an initial impact may be in compression but at higher levels than would be normally encountered over a small area, the sequential failure of the "shoe" structure translates the forces into shear on the now fully compressed inner and outer skins of the "shoe". Normal compressional forces, even when the vessel is placed in dry-dock do not involve significant accelerations of the vessel and are normally distributed over areas sufficient to reduce loading below levels encountered when the ship is fully loaded. Also, either the strength of the beam webs and flanges in compression should be less than the tensile strength of the inner and outer hulls 14, 16 or the strength of the joint between the flanges and the inner and outer hulls be designed to fail in shear at a force less than the tensile strength of the inner and outer hulls so that failure of the stand-off structures will not localize forces and cause tearing of the hull membrane of either the inner or outer hull.

Figure 5:
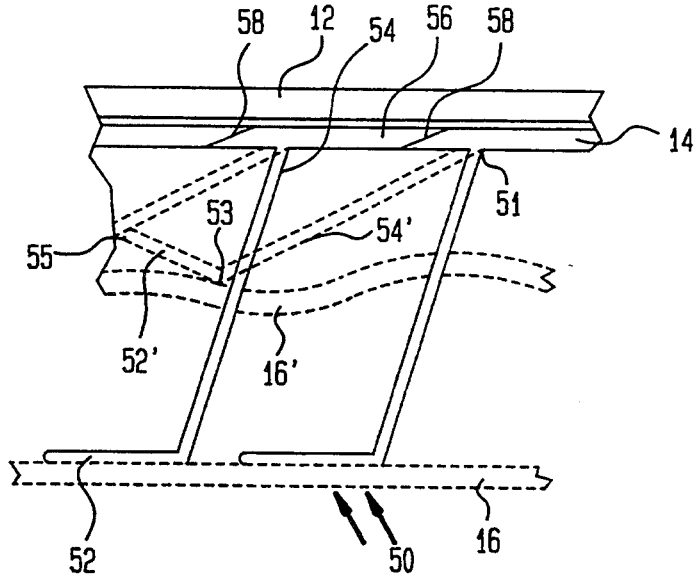

An alternative stand-off structure is shown in FIG. 5, referred to as a z-beam or z-stiffener. In this case, the "flange" 52 is formed only on one side of the "web" 54 which is also inclined in a direction away from the expected position of application of shear forces and is thus highly asymmetrical. This stand-off structure is also preferably formed of composite material but could also be formed of relatively malleable and selectively hardenable metals such as aluminum. As an example of sequential failure modes for the stand-off structure, a force 50 having a shear component applied against outer hull 16 and tending to force it to position 16' will first cause inelastic deformation at location 51. The crush resistance will increase when the end of flange 52 contacts an adjacent web 54 at point 55 and again increase as further pressure causes deformation at location 53. These further sequential failure stages also have the effect of distributing forces over a wide area as the "flanges" 52 contact adjacent "webs" 54. Substantial energy will be absorbed throughout this process and, at the same time, the flanges and webs of the stand-off structure are formed into additional layers of armoring for the existing hull 12, increasing penetration resistance. It should be noted that the structure of FIG. 5 can be formed in sections as shown at reference numeral 58 to provide a yet further layer of armoring as or in addition to the inner hull, itself, as desired.

Additionally, the z-beam or z-stiffener is preferably formed with the upper flange being wider than the lower flange. The allows the upper flanges to be joined as a continuous skin as mentioned above and also provides for the connection to the inner hull 14 or existing hull 12 (e.g. if the joined upper flanges are, themselves, utilized as inner hull 14) to be stronger than the connection of the lower flanges to outer hull 16, assuming the same bonding or joining methods (e.g. adhesive) are used for both joints. The difference between the sizes of flanges need not be large and, in fact, it is sufficient to the practice of the invention that the lower flanges not be joined even though they may be contiguous. The continuous upper flange will effectively distribute shear forces beyond the length of a single upper flange while the separate lower flanges will not do so. Therefore, under conditions of severe shear forces such as during a grounding event, the joints between the lower flanges and the outer hull will also provide a plurality of sequential, energy absorbing failures while protecting the integrity of joints between the upper flanges and between the upper flanges and the inner or existing hull.

It should also be noted that the stand-off structures of FIGS. 4 and 5 are preferably formed of a composite material for convenience and corrosion resistance and, also, for the property of exhibiting only slight elastic deflection before inelastic deformation or failure. This is considered to be of substantial importance to obtaining the full benefits of the invention since energy absorption will begin almost immediately upon impact due to brittle fractures of the reinforcing fibers. Therefore, since only minimal, if any, allowance need be made for elastic deformation, protection of the existing hull 12 can be accomplished with much reduced separation between the inner hull 14 and outer hull 16, reducing material cost and weight while also reducing vessel size and frontal area, in particular. Also, since the inner and outer hulls 14, 16 are not easily penetrated, additional energy absorption may be achieved through compression and/or controlled venting of gases or fluids within the compartments. (in this regard, the compartments of hull structure 11 can be controllably flooded for adjustment of buoyancy during operation of the vessel and such flooding can also be exploited for energy dissipation during grounding or collision.) However, since gases are somewhat compressible, albeit with the generation of heat through which energy can be dissipated, further substantial improvements can be achieved by the use of syntactic foams as will now be discussed in regard to FIG. 6.

Figure 6:
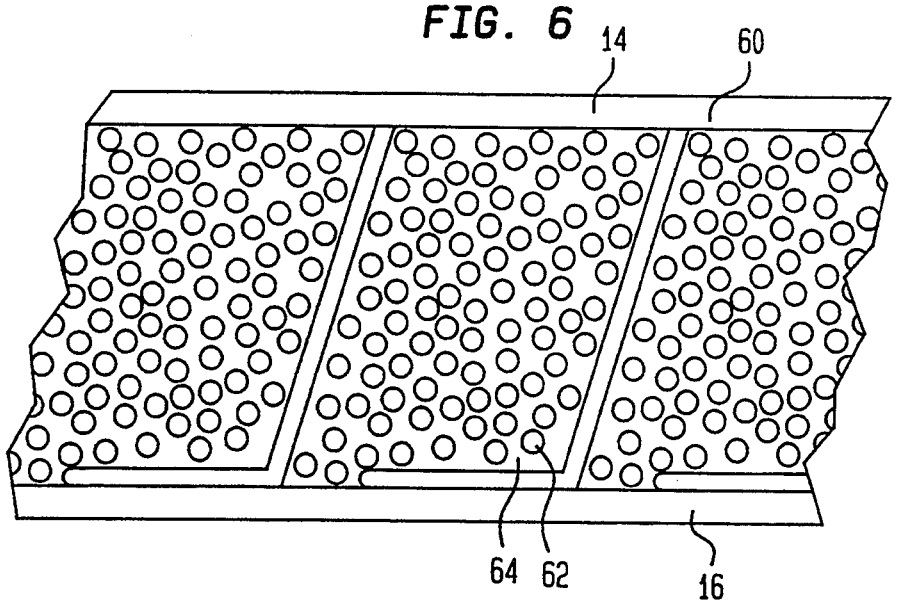
FIG. 6 illustrates a cross-section of a hull compartment including a syntactic foam in accordance with a variation of the invention.

FIG. 6 illustrates the stand-off structure 60 of FIG. 5 but filled with a syntactic foam 64. Syntactic foams may be either rigid or elastomeric foams but are characterized by the inclusion of rigid frangible bodies such as gas-filled glass spheres 62. These spheres thus individually exhibit a brittle fracture characteristic in compression and, due to the relatively random spatial distribution of the spheres or different sizes or dimensions thereof due to random manufacturing variation, will receive a sufficient force to cause breakage of a substantial continuum of displacements of the outer hull 16, stand-off structure 60 and foam 64, thus providing a great effective increase in the number of steps of sequential failure and dissipating large amounts of energy during crushing. The foam tends to insure the various portions of the stand-off structure will remain in desired positions during crushing and thus provide effective armoring for hull 12. Thus because of the combination of reduction of elastic deformation, the high degree of force absorption/energy dissipation, armoring of the hull 12, the tear resistance of outer and inner hulls 16, 14 and the distribution of forces, particularly during the later stages of failure of the stand-off structure of FIG. 5, protection of the inner hull can be achieved at separations between inner and outer hulls of only about 2–4% of vessel beam, or about one third of the required thickness of conventional double hull constructions for an equivalent degree of protection to conventional double hull designs having a separation of 6.7% to 10% of vessel beam, respectively.

While the embodiment of FIG. 6 is generally preferred since an increase of wetted frontal area of less than 10% is not particularly significant with regard to energy consumption maneuverability or other aspects of hull performance, especially in comparison with conventional double hull structures and the dimensions thereof, such thinness made available by the present invention may not be equally desirable over the entirety of the hull. For example, statistically, about 70% of hazardous cargo spillage occurs due to collisions rather than groundings which account for the remaining 30% of spillage. Also, the types and directions and locations on the outer hull of forces encountered will differ between collisions and groundings. Therefore, it is desirable to provide different yield strengths and thicknesses of the "shoe" 11 at different locations on the hull and to provide for different ratios of compression and shear forces which will cause sequential failure.

This can be done simply by providing different types of stand-off structures and different thicknesses of the double hull. For instance 2–3% of beam thickness may be entirely sufficient on the bottom of the vessel to prevent damage during grounding (e.g. the distance the vessel is likely to be lifted while sliding over an obstruction in consideration of the vessels mass) while 4% to 5% thickness would provide for adequate collision protection on the sides of the vessel. To protect the bow during collisions, perhaps two or three layers, each of 4% to 5% of beam thickness would be desirable to provide break-away protection and/or additional crushable thickness. Such break-away layers or modules reduce the cost of repair and also provide a further mode of protection by deflection of vessel.

In regard to stand-off structures, highly asymmetric structures such as that of FIG. 6 should be run athwartships, particularly on the hull bottom to provide energy absorption during groundings while more symmetrical structures such as that of FIG. 5 or even fully symmetrical structures should be run parallel to the keel (or generally longitudinally of the vessel). Particularly on the vessel bottom, the force at which longitudinally running stand-offs can advantageously be designed with a greater failure resistance than those running athwartships to provide standoff distance for submerged obstructions as a further protective mechanism. Additional stand-off members can also be included in selected locations on the hull to carry anticipated loads such as for minor collisions, contact by tugboats or for support of the hull in dry-dock, if desired.

In view of the foregoing, it is seen that the present invention provides a retrofittable hull structure which can extend the usable lifetime of existing hull structures by inhibiting or eliminating corrosion, increase the strength and damage resistance of the combination hull structure; improving resistance to damage from grounding and collisions and improve the cargo containment capabilities of hulls without significantly compromising hull performance at a cost much less than that of new construction and largely offset by the extension of usable hull lifetime and improvement of efficiency in comparison to conventional double hull designs. Further, particularly for new constructions, insurance costs should be decreased due to the avoidance of corrosion by composite materials, the reduction of need for inspection and the superior tear and penetration resistance of hulls constructed in accordance with the invention.

While the invention has been described in terms of a single preferred embodiment, those skilled in the art will recognize that the invention can be practiced with modification within the spirit and scope of the expended claims.

Having thus described my invention, what I claim as new and desire to secure by Letters Patent is as follows:

1. A hull structure, comprising:

an inner hull having a predetermined compressive strength;

an outer hull having a predetermined compressive strength;

stand-off means for maintaining separation between said inner hull and said outer hull, said stand-off means including a plurality of stand-off members, each said stand-off member coupling said inner hull and said outer hull;

said stand-off means including means for absorbing energy by a predetermined pattern of sequential failure of portions of said stand-off means;

at least one said stand,off member including a beam, said beam including flanges at opposite ends of a web, said flanges extending from opposite sides of said web, said means for absorbing energy including means for selectively weakening a portion of said beam;

each said sequential failure occurring at forces less than said predetermined compressive strength of said inner hull and said outer hull and including substantially inelastic deformation of at least two said stand-off members whereby said stand-off means is formed into additional layering which provides increased penetration resistance of said hull structure at the location of each said sequential failure.

2. A hull structure as recited in claim 1, wherein said hull structure principally comprises a composite, nonmetallic, material.

3. A hull structure as recited in claim 2 wherein said composite, non metallic, material is a fiber reinforced plastic.

4. A hull structure as recited in claim 3, wherein said fiber reinforced plastic is a glass fiber reinforced plastic.

5. A hull structure as recited in claim 2, wherein at least one said beam is asymmetric in cross-section.

6. A hull structure as recited in claim 2, wherein at least one said beam is asymmetric in cross-section.

7. A hull structure as recited in claim 1, wherein each of at least two said stand-off members includes a beam and wherein a flange of at least one said beam is attached to a corresponding flange of an adjacent beam.

8. A hull structure as recited in claim 1, wherein said means for absorbing energy includes material which fails by brittle fracture on application of a predetermined force.

9. A hull structure as recited in claim 1, further including an existing hull, said inner hull being shaped to conform to an outer surface of said existing hull.

10. A hull structure as recited in claim 9, further including an adhesive between said inner hull and said existing hull.

11. A hull structure as recited in claim 9, wherein at least one said beam is asymmetric in cross-section.

12. A hull structure as recited in claim 9, wherein each of at least two said stand-off members includes a beam and wherein a flange of at least one said beam is attached to a corresponding flange of an adjacent beam.

13. A hull structure as recited in claim 9, wherein said means for absorbing energy includes material which fails by brittle fracture on application of a predetermined force.

14. A hull structure as recited in claim 13, wherein said material which fails by brittle fracture includes a syntactic foam.

15. A retrofittable hull structure for application to an existing steel hull, comprising:

an inner hull member;

an outer hull member;

a plurality of beams, each said beam coupling said inner hull member and said outer hull member;

said inner hull member, said outer hull member and each said beam being comprised of a composite material;

each said beam having a web and two flanges, one said flange at each end of said web, each said flange extending with respect to the other said flange from the opposite side of said web;

means for selectively weakening, at at least one location of each said beam, each of at least two said beams;

means for application of said inner hull member to said existing steel hull;

whereby said retrofittable hull structure, when applied to said existing steel hull, increases penetration resistance of said existing hull; and whereby in response to predetermined forces said retrofittable hull structure will fail in a predetermined sequence to absorb energy;

said predetermined sequence including substantially inelastic deformation of at least two said beams such that said beams are formed into additional layering of said retrofittable hull structure so as to further increase said penetration resistance of said existing hull.

16. A hull structure, comprising:

an inner hull member;

an outer hull member;

a plurality of stand-off members;

each said stand-off member interposed between and coupling said inner hull member and said outer hull member;

each said stand-off member including a beam having a web and two flanges, one said flange at each end of said web, each said flange extending with respect to the other said flange from the opposite side of said web;

means for selectively weakening, at at least one location of each said beam, each of at least two said beams;

whereby shear and compression forces, predeterminedly, are incapable of causing failure of said inner hull member and said outer hull member and are capable of causing systematic failure of said plurality of stand-off members;

each said systematic failure including absorption of said forces, dissipation of energy and substantially inelastic deformation of at least two said stand-off members such that additional layering providing increased penetration resistance of said hull structure is thereby formed at the location of each said systematic failure.

17. A hull structure as recited in claim 16, further including means for application of said inner hull member to an existing hull.

18. A hull structure, comprising:

an inner hull having a predetermined compressive strength;

an outer hull having a predetermined compressive strength;

stand-off means for maintaining separation between said inner hull and said outer hull, said stand-off means including a plurality of stand-off members, each said stand-off member coupling said inner hull and said outer hull;

said stand-off means including means for absorbing energy by a predetermined pattern of sequential failure of portions of said stand-off means;

at least one said stand-off member including a beam, said beam including flanges at opposite ends of a web, said means for absorbing energy including means for selectively weakening a portion of said beam, said means for selectively weakening a portion of said beam including at least one notch in said web of said beam;

each said sequential failure occurring at forces less than said predetermined compressive strength of said inner hull and said outer hull and including substantially inelastic deformation of at least two said stand-off members whereby said stand-off means is formed into additional layering which provides increased penetration resistance of said hull structure at the location of each said sequential failure.

19. A retrofittable hull structure for application to an existing steel hull, comprising:

an inner hull member;

an outer hull member;

a plurality of beams, each said beam coupling said inner hull member and said outer hull member;

said inner hull member, said outer hull member and each said beam being comprised of a composite material;

each said beam having a web and two flanges, one said flange at each end of said web;

means for selectively weakening, at at least one location of each said beam, each of at least two said beams, said means for selectively weakening including at least one notch in said web of each said beam;

means for application of said inner hull member to said existing steel hull;

whereby said retrofittable hull structure, when applied to said existing steel hull, increases penetration resistance of said existing hull; and whereby in response to predetermined forces said retrofittable hull structure will fail in a predetermined sequence to absorb energy;

said predetermined sequence including substantially inelastic deformation of at least two said beams such that said beams are formed into additional layering of said retrofittable hull structure so as to further increase said penetration resistance of said existing hull.

20. A hull structure, comprising:

an inner hull member;

an outer hull member;

a plurality of stand-off members;

each said stand-off member interposed between and coupling said inner hull member and said outer hull member;

each said stand-off member including a beam having a web and two flanges, one said flange at each end of said web;

means for selectively weakening, at at least one location of each said beam, each of at least two said beams, said means for selectively weakening including at least one notch in said web of each said beam;

whereby shear and compression forces, predeterminedly, are incapable of causing failure of said inner hull member and said outer hull member and are capable of causing systematic failure of said plurality of stand-off members;

each said systematic failure including absorption of said forces, dissipation of energy and substantially inelastic deformation of at least two said stand-off members such that additional layering providing increased penetration resistance of said hull structure is thereby formed at the location of each said systematic failure.

21. A hull structure as recited in claim 18, further including an existing hull, said inner hull being shaped to conform to an outer surface of said existing hull.

22. A hull structure as recited in claim 20, further including means for application of said inner hull member to an existing hull.

23. A hull structure as recited in claim 18, wherein at least one said beam is asymmetric in cross-section.

24. A hull structure as recited in claim 15, wherein at least one said beam is asymmetric in cross-section.

25. A hull structure as recited in claim 16, wherein at least one said beam is asymmetric in cross-section.

26. A hull structure as recited in claim 19, wherein at least one said beam is asymmetric in cross-section.

27. A hull structure as recited in claim 20, wherein at least one said beam is asymmetric in cross-section.

* * * * *